United States Patent [19]

Norris

[11] 4,320,815

[45] Mar. 23, 1982

[54] NOISE REDUCTION IN ENGINE EXHAUST

[75] Inventor: Thomas R. Norris, Orinda, Calif.

[73] Assignee: The United States of America as represented by the Secretary of the Army, Washington, D.C.

[21] Appl. No.: 159,730

[22] Filed: Jun. 16, 1980

[51] Int. Cl.[3] ..... F01N 1/08; F01N 1/16

[52] U.S. Cl. ..... 181/226; 181/278

[58] Field of Search ..... 181/226, 227, 228, 277, 181/278, 239, 275, 268

[56] References Cited

U.S. PATENT DOCUMENTS

| | | | |
|---|---|---|---|
| 3,111,192 | 11/1963 | Recupito | 181/278 |
| 3,346,071 | 10/1967 | Lader | 181/277 X |
| 3,703,937 | 11/1972 | Tenney | 181/226 |
| 3,969,895 | 7/1976 | Krizman | 181/278 X |

FOREIGN PATENT DOCUMENTS

| | | | |
|---|---|---|---|
| 393383 | 8/1908 | France | 181/278 |
| 714192 | 11/1931 | France | 181/278 |

*Primary Examiner*—L. T. Hix
*Assistant Examiner*—Thomas H. Tarcza
*Attorney, Agent, or Firm*—Peter A. Taucher; John E. McRae; Nathan Edelberg

[57] ABSTRACT

Noise reduction mechanism for an engine, especially effective during idling and operation at low RPM, is disclosed. Under those conditions, engine exhaust noise often represents a predominant part of the total vehicle noise. The noise reducing mechanism comprises a flow-throttling element that substantially closes the main exhaust passage when the engine is in the low-speed range; the exhaust gas and noise is forced to flow through a more effective muffling device to reduce the noise at the exit end of the system. At high engine speeds, the throttling mechanism is deflected to a maximum flow condition for avoidance of undesired back pressure in the exhaust system.

2 Claims, 5 Drawing Figures

NOISE REDUCTION IN ENGINE EXHAUST

BACKGROUND AND SUMMARY OF THE INVENTION

In operation of military vehicles it is often desired to reduce the airborne exterior noise signature in order to avoid possible detection of the vehicle by enemy forces. At high vehicle speeds the track and suspension noise is a predominant part of the total vehicle noise output. At lower vehicle speeds, or at standstill, the engine exhaust noise is usually the principle noise source. The present invention is directed to a noise reduction mechanism for the engine exhaust. The mechanism is designed to be especially effective at low engine speeds, which is from idle up to about 1000 r.p.m. or slightly beyond, for many vehicles.

In one embodiment of the invention the mechanism includes a flow-throttling element arranged in a vertical pipe that forms the exit opening from a conventional engine muffler. The flow-throttling element has a central passage therethrough that provides a continuous path for escape of combusted gases from the muffler at all engine speeds. At low engine speeds the weight of the flow-throttling element causes the element to close a main annular port or passage, thus confining the entire flow to the smaller central passage; which provides effective muffling and lessened total emitted noise. At high engine speeds the greater exhaust flow forces the flow-throttling element upwardly to a position wherein the main annular port is opened, thereby avoiding back pressure effects which could otherwise occur at high engine speeds. The noise reduction effect at high engine speeds is thereby lessened.

I am aware of U.S. Pat. No. 3,703,937 which discloses the use of a movable flow-throttling element in an engine exhaust system. However, in that patented arrangement the flow-throttling element is normally biased toward an open condition; at high engine speeds the patentee attempts to utilize aerodynamic forces in the flowing gas to lift the throttling element to a closed position wherein the element acts as a reflecting surface for an oncoming pressure wave. The patented system is said to be especially adapted to two cycle engines for more effectively preventing undesired escape of fresh charge gases with the exhaust gases during exhaust-charging transition period in the engine cycle. I believe my throttling system is conceptually different than that of the system shown in U.S. Pat. No. 3,703,937.

The invention described herein may be manufactured, used, and licensed by or for the Government for governmental purposes without payment to me of any royalty thereon.

THE DRAWINGS

Figure 1:
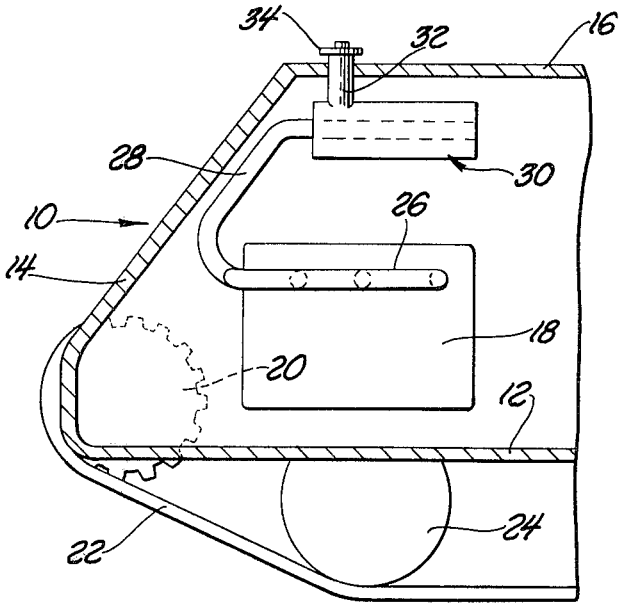
FIG. 1 is a fragmentary sectional view through a military vehicle embodying an engine equipped with a noise reduction mechanism constructed according to the teachings of my invention.

Referring in greater detail to FIG. 1 of the drawings, there is schematically shown a tracked military vehicle used by the U.S. military, and designated as the M113. This vehicle includes a hull 10 having a floor 12, front wall 14 and roof 16. The vehicle propulsion system includes a six cylinder diesel engine 18, and a non-illustrated transmission, which drives sprockets 20 that orbit the conventional endless tracks 22 under a system or roadwheels 24. The engine in this particular vehicle has an output of approximately 212 horsepower (without supercharging).

Figure 2:
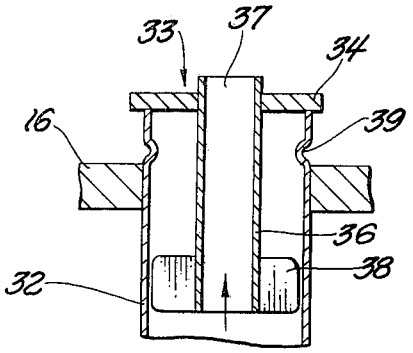
FIG. 2 illustrates a structural arrangement utilized in the noise reduction mechanism of the FIG. 1 vehicle.
Figure 3:
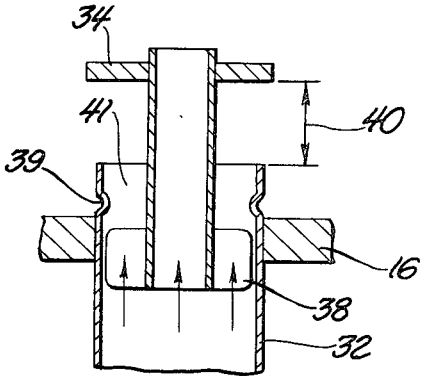
FIG. 3 illustrates the FIG. 2 noise reduction structure, when deflected by combustion gases to a maximum flow area condition.
Figure 4:
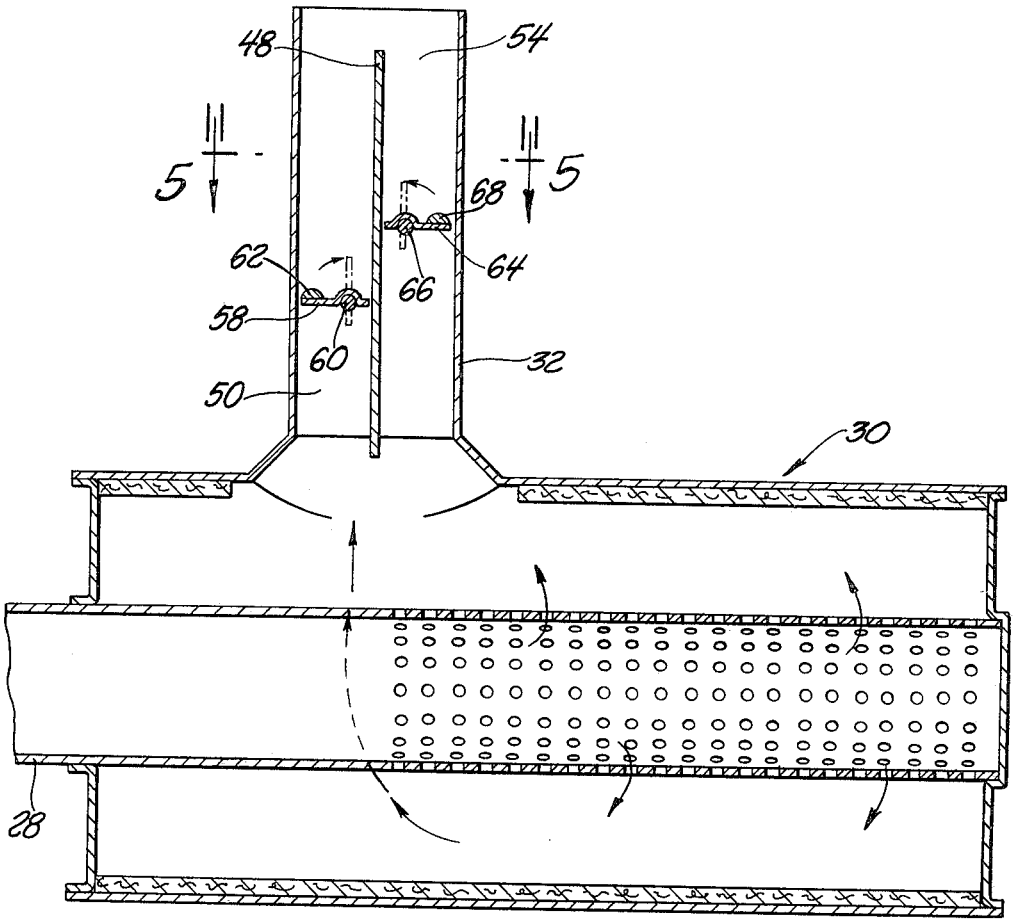
FIG. 4 shows in section a second form that my noise reduction mechanism can take.

The engine cylinders are arranged in left and right banks of cylinders, each cylinder having a pair of exhaust valves for discharging combustion gases to an exhaust manifold 26. The left and right manifolds connect with a single exhaust pipe 28 that leads to a muffler 30 constructed as shown in FIG. 4. Hot combustion gases are discharged from the muffler through a vertical pipe 32 that extends upwardly through roof 16. FIGS. 2 and 3 illustrate a flow-throttling means 33 disposed within pipe 32.

The illustrated flow-throttling means 33 includes a platelike valve element 34 affixed to a tube 36 that descends into pipe 32. At its lower end tube 36 carries four outwardly radiating guide vanes 38, whose purpose is to maintain tube 36 in a centered position during movement of the plate-tube unit from the FIG. 2 minimum flow area position to the FIG. 3 maximum flow area position. The weight of the tube-plate assembly biases the assembly downwardly to the FIG. 2 position except when the engine is at a sufficient speed that exhaust gas pressure pneumatically raises the assembly toward the FIG. 3 position; rib 39 retains the assembly by limiting its upward movement. The flow-throttling assembly can take various intermediate positions between the FIG. 2 and FIG. 3 conditions depending primarily on variations in engine speed, or acceleration-deceleration conditions.

In the FIG. 2 position upflow of combustion gases is confined to the central passage 37 defined by tube 36. In the FIG. 3 position the gases can flow through the central passage and also through the surrounding annular passage 41 formed between the tube 36 outer surface and the pipe 32 inner surface. Control of the flow through the annular passage is related to the spacing 40 between plate 34 and the upper edge of pipe 32.

When the engine is operating at idling speed, e.g. about 625 revolutions per minute, the throttling assembly generally assumes the FIG. 2 minimum flow area position. As the engine speed is increased into the intermediate speed range (above 1000 revolutions per minute) and high speed range (above 2000 r.p.m.) the flow-throttling assembly moves progressively toward the FIG. 3 maximum flow area position. The throttling action has the advantageous effect of reducing the exhaust noise, including the low frequency noise associated with idling engine operation.

The weight or downward bias of the throttling means 33 is preferably selected in conjunction with the sizing of passages 37 and 41 so that the average static back-pressure in exhaust pipe 28 is relatively constant throughout most of the upper-r.p.m. range of the engine, from at or slightly above idling r.p.m. up through maximum r.p.m. In one particular case the mechanism was sized to include a pipe 32 of about four inches diameter, and a tube 36 with a diameter of about one and one-half inches. With these dimensions passage 37 provided approximately fifteen percent of the total maximum flow area, and passage 41 provided the remaining eighty-five percent of the total maximum flow area.

The system should be designed to avoid excessive increased backpressure at the higher engine speeds, as would result from an unduly restrictive venting of exhaust flow through space 40 (FIG. 3). A static pressure gage in pipe 28 may be used to inform the designer when the pressure is maintained at or below the engineer's backpressure limit throughout the speed range of the engine.

Figure 5:
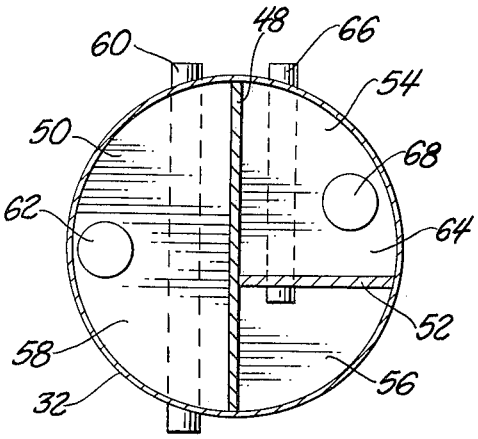
FIG. 5 is a sectional view on line 5—5 in FIG. 4.

The throttling mechanism of FIG. 2 is essentially a variable flow device that operates in the minimum flow area condition, intermediate flow conditions (FIG. 2), or the maximum flow area condition (FIG. 3). FIGS. 4 and 5 illustrate a variant of the invention having three stages rather than two. The mechanism includes a vertical pipe 32 having a first vertical partition 48 spanning the pipe along its diameter to define a first semicircular passage 50. A second partition 52 extends right angularly from partition 48 at a point slightly offset from the pipe 32 axis, thereby forming a second passage 54 and a third passage 56. In the particular case shown, the partition arrangement is such that passage 50 forms about fifty percent of the total flow area, passage 54 forms about thirty-five percent of the total flow area, and passage 56 forms about fifteen percent of the total flow area.

Arranged within passage 50 is a flow-throttling valve element plate 58 secured to a rotary shaft 60 for movement between an illustrated zero flow position extending transverse to the passage length and a maximum flow position extending parallel to the passage axis. A weight 62 is carried on the plate to normally bias the plate to the zero flow condition in opposition to the force of the gases flowing upwardly through passage 50.

Passage 54 is provided with a flow-throttling plate 64 mounted on a rotary shaft 66 for movement between a minimum flow position transverse to the passage axis and a maximum flow position parallel to the passage axis. A weight 68 is carried on plate 64 to bias it toward the low-flow position. The remaining passage 56 has not throttling element, but is continuously open to define the minimum effective flow area (along with leakage clearances around the valves) of the system when valve elements 58 and 64 are both closed (as shown in FIG. 4).

The weight 62 is preferably sized so that plate 64 is deflected toward the open condition in a lower range of engine speeds than plate 58. At engine idling speeds (e.g. 650 r.p.m.) the entire flow is through passage 56, both valve elements 58 and 64 being closed. In an intermediate engine speed range (e.g. above 1000 r.p.m.) valve element 64 opens to increase the total flow area. In a high engine speed range (e.g. above 2000 r.p.m.) valve element 58 opens. The general operation of the valve system is similar to that of the FIG. 2 system except for the addition of a third stage. With an optimized design the FIG. 5 arrangement can probably achieve noise reduction over a greater engine speed range than the FIG. 2 arrangement, while avoiding undesired backpressure effects at the high speed range.

I wish it to be understood that I do not desire to be limited to the exact details of construction shown and described for obvious modifications will occur to a person skilled in the art.

I claim:

1. In a vehicle having an engine, and an exhaust system for the combustion by products produced by said engine: the improvement comprising an exhaust noise reduction mechanism; said noise reduction mechanism including a circular pipe arranged to discharge said combustion by products into the ambient atmosphere; a means for partitioning the pipe into three separate passages, including a first partition spanning the pipe near its diameter to define a first passage, and a second partition extending normal to the first partition to define second and third passage; the two partitions being oriented so that the first passage has the largest flow area, the second passage has an intermediate flow area, and the third passage has the smallest flow area; a first flow throttling plate swingably mounted in the first passage for rotation around an axis transverse to the first passage axis whereby said plate is movable between a zero flow position extending transverse to the first passage axis and a maximum flow condition extending parallel to the first passage axis; means biasing the first flow throttling plate toward its zero flow position in opposition to the force of the exhaust gases flowing from the engine through the first passage; second flow throttling plate swingably mounted in the second passage for rotation around an axis transverse to the second passage axis whereby said second plate is movable between a zero flow position extending transverse to the second passage axis and a maximum flow condition extending parallel to the second passage axis; second means biasing the second flow throttling plate toward its zero flow position in opposition to the force of the exhaust gases flowing from the engine through the second passage; said third passage being devoid of flow throttling mechanisms whereby said third passage is in a continuously open condition; the biasing means for the second flow throttling plate being effectively weaker than the biasing means for the first flow throttling plate whereby the second throttling plate has movement in the intermediate range of engine speed and the first throttling plate has movement in a higher range of engine speeds, the first and second biasing means and flow throttling plates being sized so that the average static pressure in the exhaust system does not exceed the particular engines back pressure limit throughout the speed range of the engine, from idle up to maximum speed.

2. The improvement of claim 1 wherein the second partition extending right angularly to the first partition at a point offset from the pipe axis whereby the third passage constitutes about fifteen percent of the total flow area, the second passage constitutes about thirty-five percent of the total flow area and the first passage constitutes about fify percent of the total flow area.

* * * * *